United States Patent [19]

Evenson

[11] Patent Number: 4,597,716

[45] Date of Patent: Jul. 1, 1986

[54] AIR ACTIVATED VACUUM PUMP

[75] Inventor: Edward Evenson, Chicago, Ill.

[73] Assignee: Milton Industries, Inc., Chicago, Ill.

[21] Appl. No.: 623,577

[22] Filed: Jun. 22, 1984

[51] Int. Cl.[4] ..... F04F 5/44

[52] U.S. Cl. ..... 417/181; 417/63; 417/185; 417/198

[58] Field of Search ..... 417/181, 185, 151, 234, 417/198, 176, 196, 63, 167, 178

[56] References Cited

U.S. PATENT DOCUMENTS

| | | | |
|---|---|---|---|
| 1,498,663 | 6/1924 | Losel | 417/167 |
| 1,868,758 | 7/1932 | Nelson | 417/198 |
| 2,458,508 | 1/1949 | Goetz | 417/190 |
| 2,690,717 | 10/1954 | Goodrie | 417/190 |
| 2,910,009 | 10/1959 | Fraser et al. | 417/151 |
| 4,290,446 | 9/1981 | Seiler | 417/185 X |

*Primary Examiner*—Edward K. Look

[57] ABSTRACT

A hand held and controlled air activated vacuum pump for testing vacuum systems and controls against atmospheric exudations that adversely affect their performance.

4 Claims, 5 Drawing Figures

AIR ACTIVATED VACUUM PUMP

SUMMARY

Todays automotive equipment are employing more vacuum systems and controls than ever before. They are found in virtually every automotive system from emission and carburation controls to computerized feed-back circuits, many performing critical functions where even the slightest vacuum leak can adversely affect the performance of the system.

It is an object of this invention to provide a hand held and controlled air activated vacuum pump having no movable parts which is simple in operation when conveniently connected to a vacuum gauge and to a component of the vacuum system to be tested. The device is highly effective in use and economical to manufacture.

The air activated vacuum pump of this invention includes a conveniently hand held body that provides a center bore that houses a needlelike air passage nozzle which in turn cooperates with internal configurations so as to produce a Venturi effect.

The associated branch tube of the Venturi are conveniently connected to a pressure gauge and the vacuum systems being tested, with the resulting vacuum thereon being conveniently regulated by the hand holding the vacuum pump.

Other objects will appear and be made more apparent in the following disclosure of this invention.

DESCRIPTION OF THE DRAWINGS

The invention will be best understood by reference to the accompanying drawings in which there is illustrated the preferred form of construction by which the stated objects of the invention are achieved and in which.

GENERAL DISCRIPTION

Figure 5:
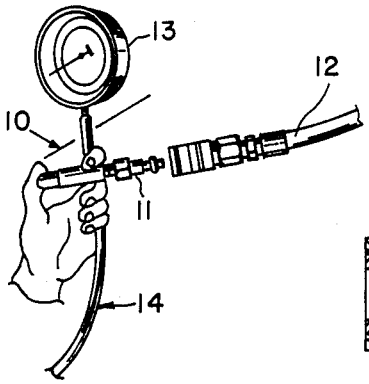
FIG. 5 is a perspective view of the invention in its invironmental use.

As shown in FIG. 5 the vacuum pump 10 includes a coupler 11 by which it is readily connected to an air supply hose 12. Also in its operative environment, the pump 10 has associated therewith a pressure gauge 13, and a test hose 14 attached to the vacuum system being monitored.

Figure 1:
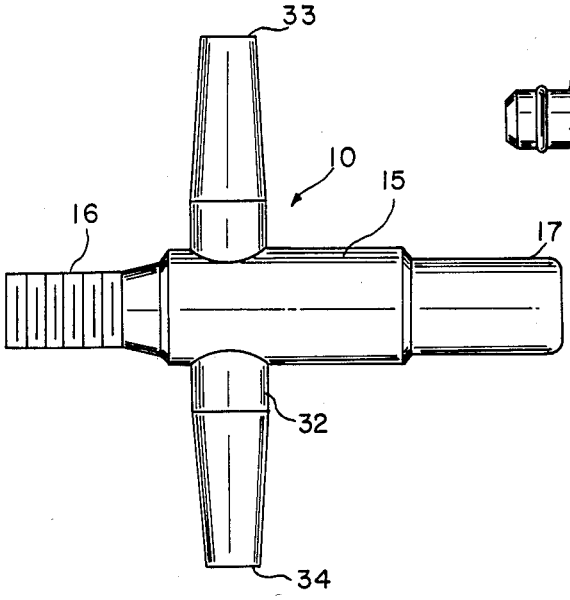
FIG. 1 is a side elevational view of the invention.
Figure 3:
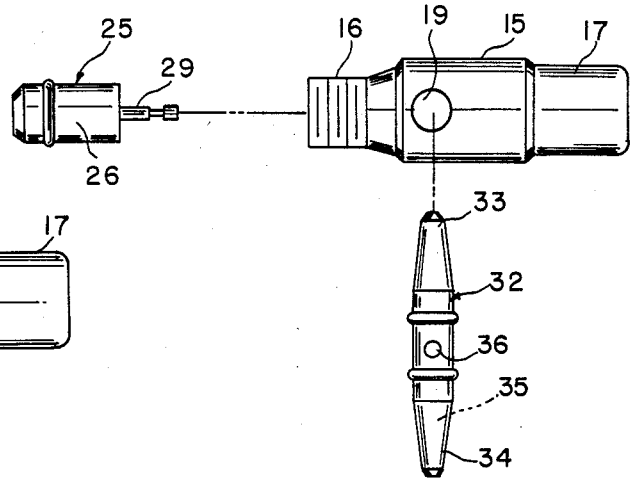
FIG. 3 is a plan elevational view of the invention with certain components shown in exploded relationship.
Figure 2:
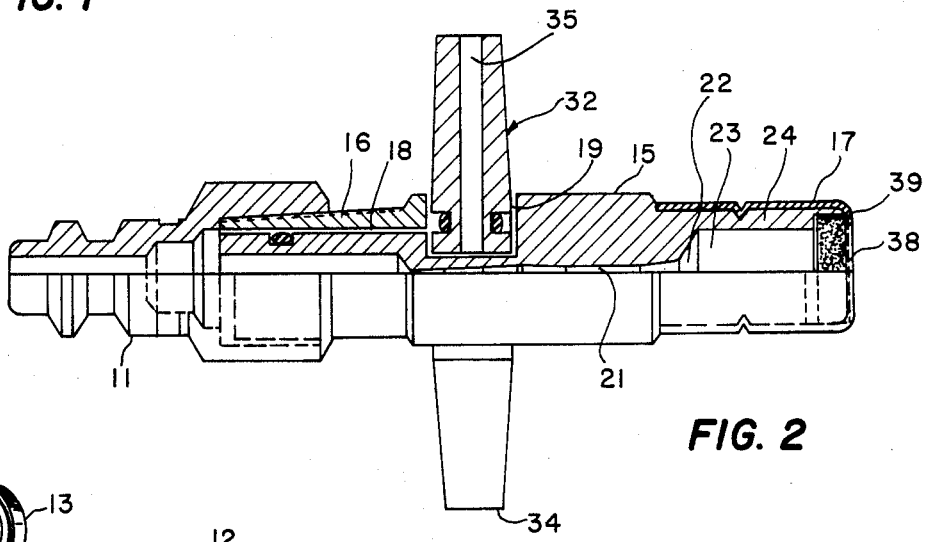
FIG. 2 is a side elevational fragmentarily detailed sectional view of the invention.

As shown in FIG. 3 the pump 10 includes a cylindrical body 15 having a threaded end 16 adapted to receive the coupler 11 and a cap like member 17, frictionally positioned on the opposite end.

Figure 4:
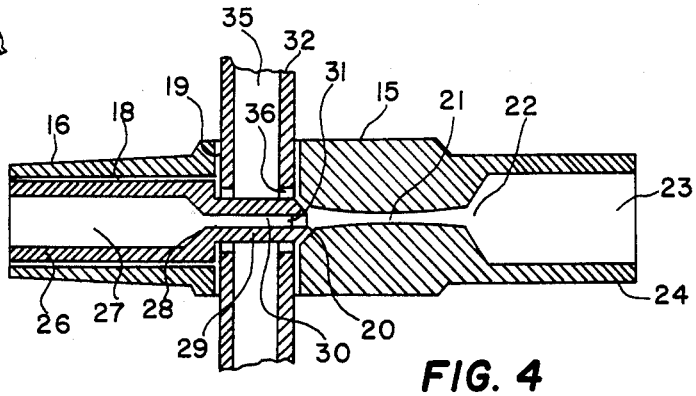
FIG. 4 is a side elevational detailed sectional view of certain interior components of the invention.

As shown in FIG. 4 the cylindrical body 15 is formed with a center bore 18 extending through the threaded end 16 thereof, which has communication with a transverse circular cross bore 19. Formed in one wall of the cross bore 19 is a conically shaped mouth 20, the base of which is in open communication with a throat 21, that terminates in a conical orifice 22 opening into an exhaust port 23. It should be noted that the conical orifce 22 and the exhaust port 23 are within the end 24 of the body 15 which is normally covered by the cap 17.

Adapted to positioned within the bore 18 and projecting through the cross bore 19 and in juxtaposition with the mouth 20 is a channeled intake plug 25. This plug 25 includes a circular insert 26 having a diameter adapted to be frictionally received within the bore 18. As seen in FIG. 4 the insert is provided with a center bore 27 that terminates at one end into a conical mouth 28. Extending through the needle-like nose 29 of the plug 25 is a canal 30 having open communication with the mouth 28 at one end, and a vent 31 at its opposite end.

Positioned within the cross bore 19 is a branch 32. This branch 32 provides tapered ends 33 and 34 adapted to be exposed beyond opposite sides of the body 15. The branch 32 has formed therein, throughout its longitudinal length, an air passage 35, and at a mid-point, is formed to provide a circular cross aperture 36.

Adjacent to its mid-point the branch 32 carries sealing gaskets 37, so that when the branch 32 is positioned in the cross bore 19 it will be sealed with respect to the body 15.

When the branch 32 is positioned within the cross bore 19 the needle 29 will extend through the aperture 36 bisecting the air passage 35. It should be noted that the needle 29 has an outside diameter less than the aperture 36, so as to permit air movement through the passage 35, the cross aperture 26, about the needle 29, and into the mouth 20.

The cap 17 which fits upon the end 24 of the body 15 has its end wall cut out to provide an opening 38 which is in turn curtained by an interior filter 39.

The foregoing constitutes the structural description of the hand held, thumb regulated, vacuum pump of this invention. In use one simply connects the pump 10 by the coupler 11 to an air supply hose 12. This provides a continuous source of controlable vacuum that requires no hand pumping and involves no moveable parts. By simply connecting the pump 10 through the test hose 14 to the system to be checked and controlling the vacuum by placing the thumb over the open cap 17, a testing vacuum is applied, When the determined degree of vacuum has been obtained the test hose 14 is pinched and the gauge 13 is read. If the reading increases you have determined a leak in the system.

In obtaining the above described operation it is noted that the air supplied to the pump 10 through the coupler 11 enters the center bore 27 formed in the needle valve structure 25, it passes through the canal 30 of the reduced needle 29 and under increased pressure is impinged in the mouth area 20. The admitted pressurized air passes through the throat 22 and on into the exhaust port 23. The exhausted air passes through the filter 39 and out the port 38 of the cap 17. The degree of vacuum is regulated by the thumb of the user by restricting the volume of air discharged through the cap 17. This forceful movement of air, by reason of the Venturi principle, draws the vacuum fluid through the branch 32. The fluid coming through the end 33 of the branch 32 will cause a reading on the gauge 13. The fluid drawn through the end 34 of the branch 32 creates a vacuum in the system to be tested.

I have heretofore described a structure by which I have created a hand held thumb regulated vacuum pump that embodies no moving parts and is capable of determining leaks in pressure systems having determined pressure values. The vacuum pump 10 is so formed that its circular body 15 will readily fit between two fingers as it is hand held. The branch 32 is of such a length that its ends 33 and 34 may be restrained by the fingers in such a manner so as to place the exhaust end 17 of the body 15 adjacent the thumb of the hand holding the pump. With the thumb covering a portion of the exhaust port 23 the vacuum created in the branch 32 may be regulated.

While I have illustrated and described the preferred form of construction for carrying my invention into effect, this is capable of variation and modification without departing from the spirit of the invention. I, therefore, do not wish to be limited to the precise details of construction as set forth, but desire to avail myself of such variations and modifications as come within the scope of the appended claims.

Having thus described the invention, what I claim as new and desire to secure by Letters Patent is:

1. A hand held thumb regulated vacuum pump comprising:

(a) an elongated cylindrical body of a size to be held between the fingers of a hand and provided at one end with a recessed inlet port and at its opposite end a recessed exhaust port, (b) an internal fluid passage having a diameter less than said recessed inlet and outlet ports and extending axially of said body to provide open communication between said inlet port and said exhaust port, (c) a cross bore extending through said inlet port adjacent to one end of said fluid passage, (d) a hollow branch projected into said cross bore and through said inlet port adjacent said fluid passage, sealing said cross bore to either side of said inlet port, (e) said hollow branch transpierced along its midline so as to provide a cross opening having a diameter smaller than that of said recessed inlet port and greater than that of said fluid passage, (f) a channeled plug positioned in said inlet port providing a needle-like nose projecting through the transpierced hollow branch and terminating adjacent to one end of said fluid passage, (g) said fluid passage providing a converging entrance in communication with said cross opening of said hollow branch and into which said needle-like nose of said channel plug porjects so as to direct a fluid medium therethrough and into said recessed exhaust port, and (h) an open cap for said recessed exhaust port, closable by the thumb of the hand holding said vacuum pump for regulating the passage of vacuum induced fluid therethrough.

2. A hand held thumb regulated vacuum pump as defined by claim 1 including a filter within said cap for filtering the exhaust of said pump.

3. A hand held thumb regulated vacuum pump as defined by claim 1 wherein said needle-like nose of said channeled plug is of a diameter less than the transpierced opening formed in said holow branch and of a length so as to extend therethrough to permit unrestricted flow of fluids around said needle-like nose and into said fluid passage and said recessed exhaust port.

4. A hand held thumb regulated vacuum pump as defined by claim 3 including a filter within said cap for filtering the exhaust of said pump.

* * * * *